United States Patent [19]

Serra Bou

[11] 4,426,345

[45] Jan. 17, 1984

[54] PROCESS FOR OBTAINING REVOLVING BODIES FOR CONSTRUCTION FROM AGGREGATES AND A BINDER

[76] Inventor: Francisco Serra Bou, Corazón de María, 10 Gerona, Spain

[21] Appl. No.: 326,674

[22] Filed: Dec. 1, 1981

[30] Foreign Application Priority Data

Dec. 11, 1980 [ES] Spain ..... 497.644

[51] Int. Cl.[3] ..... B28B 1/16

[52] U.S. Cl. ..... 264/256; 264/308; 264/310; 264/DIG. 57

[58] Field of Search ..... 264/308, 310, 333, 256

[56] References Cited

U.S. PATENT DOCUMENTS 1,244,608 10/1917 Hicks ..... 264/256

2,696,353 12/1954 Vessels ..... 264/308

FOREIGN PATENT DOCUMENTS 54-50565 4/1979 Japan ..... 264/310

*Primary Examiner*—Jay H. Woo

*Assistant Examiner*—James C. Housel

*Attorney, Agent, or Firm*—Wenderoth, Lind & Ponack

[57] ABSTRACT

A process for forming a baluster constructed from aggregates and a binder includes depositing on a core, preferably of metal, which is subjected to a rotary movement about its axis at a speed of not more than two revolutions per second, a first layer of concrete to obtain a cylindrical mass which is joined to the core and which is compacted by the action of a knife which strikes the surface of rotation, towards which there is driven or pushed the concrete which, once dimensionally stabilized in a presetting operation, is subjected to a second operation in which there is deposited a second layer of concrete having a finer granulometry. The knife has a shape which is the negative of that which is to be given to the piece with the mass being compacted by the action of the knife. Plural successive layers with a finer granulometry and a richer proportion may be supplied until the contemplated shape and dimensions are reached. The body is subjected, after presetting, to complementary ornamental operations by conventional means.

5 Claims, 6 Drawing Figures

1
2
3
1
12
6
11
10
9
4
8
2
1
3
5

PROCESS FOR OBTAINING REVOLVING BODIES FOR CONSTRUCTION FROM AGGREGATES AND A BINDER

BACKGROUND OF THE INVENTION

The present invention relates to a process for producing, from aggregates together with a binder, balusters and monopiece columns having an appearance, a consistency and a behaviour which are at least on the same level as those obtained by conventional methods.

The process of the invention employs a metal core on which there are deposited, in successive layers, aggregates having different granulometries and proportionings, together with the suitable binder, thereby thickening the core until a desired final volume and shape is obtained.

Balusters traditionally have been constructed from stone, whereby skillful craftsmen are required. However, the progressive increase of the cost of manual labour has increased the cost of such balusters until it has become completely prohibitive. Therefore, it has become cheaper to demolish existing balusters in need of repair and to replace them with railings than to undertake substantial repair of such balusters.

An alternative resides in forming molded balusters by filling, with the inclusion of a framework, the interior of a negative mold in which a mass of concrete is compacted and after a presetting time has lapsed, removing the mold, thus obtaining positive copies. This process nevertheless has two main disadvantages: the construction of the mold and the need for superfine aggregate enriched proportionings.

In fact, the mold is expensive and remains filled, during the presetting time, with the mass to be molded. Therefore, the mold is inoperative for a period of time of from 50 to 60 times greater than the actual molding time.

Under these circumstances, production is very slow and many molds are required, with the result that the profitability of the mold is not acceptable.

On the other hand, the mass to be molded should have a binder-enriched proportioning and a sufficiently fine sand should be used as the aggregate, to facilitate a finish similar to that of stone. Thus, although the molded baluster is much cheaper than that of stone, it still is so expensive that the utilization thereof is rejected by builders, to the detriment of the nobility of the architecture, with resort to more simple and much less monumental styles.

However, gardens and palaces still must be reconstructed, enlarged and even planned and, therefore, balusters still have a market.

SUMMARY OF THE INVENTION

The present invention provides a novel process in which the mold is cheap and always productive, since it only acts on the mass when shaping it and it can immediately be reutilized on successive masses while the presetting of that already molded is taking place.

An object of the invention is to reduce the cost of the baluster, insofar as the raw material used is concerned, utilizing different aggregate granulometries and proportionings so that only the outer layer is the richest to give a clear finish to the piece, and thus having favourable impact on the cost.

The invention is carried out by providing a preferably metallic core which is subjected to a rotary movement about its axis at a speed not greater than two revolutions per second.

A first layer of concrete is deposited on this core to obtain a cylindrical mass joined to the core which is compacted by the action of a knife which, radially or not, strikes the surface of rotation of the mass, towards which the concrete is driven or pushed.

Once the assembly is dimensionally stabilized by means of presetting, it is subjected to a second operation in which there is deposited a second layer of concrete having a much finer granulometry, during which a knife is employed having a shape complementary to the desired shape which the finished baluster is to have, the mass being compacted by the action of such knife.

The preset assembly may receive plural successive layers having a finger granulometry and a richer proportioning, until the contemplated dimensions and shape are reached, thereafter subjecting the piece, after presetting, to complementary ornamental operations by conventional means.

BRIEF DESCRIPTION OF THE DRAWINGS

The invention now will be described in further detail with reference to the accompanying drawings which schematically represent one embodiment of the process of this invention, and wherein.

DETAILED DESCRIPTION OF THE INVENTION

Figures 1, 2, 3:
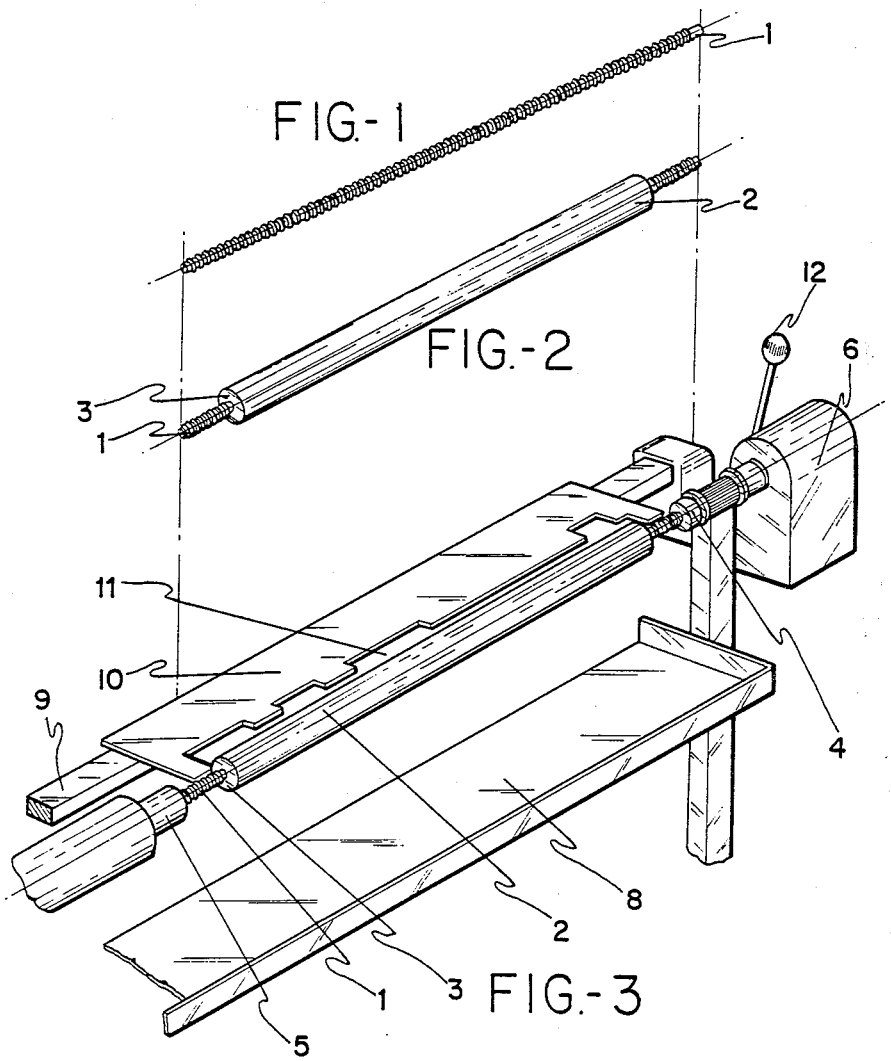
FIG. 1 is a perspective view of a core which includes a steel bar of the type conventionally used in frameworks for concrete and which is provided with projections constituting axial retention means.
FIG. 2 is a perspective view of a thickened core ready to receive a first molded base.
FIG. 3 is a perspective view of the thickened core positioned between rotatable points of a support and positioned adjacent a shaped knife by means of which a mass may be added to the core and which shapes the profile to the piece.

Referring to the drawings, a metallic core 1 is coated in a first step. Thus it has been demonstrated as ideal in practice to form a tubular body 2 of, for example, fiber cement which is centered around core 1 and filled with concrete and then preset.

Once the assembly formed of the core 1 and the tubular body 2 filled with the inner concrete mass 3 has a suitable consistency, it is fixed between support members 4 and 5. Member 4 is rotated by means of a motor and reduction gear assembly 6, while the member 5 is driven.

Both members 4 and 5 are supported on a frame 7 with has a tray 8 in which the mass of concrete is collected to be immediately re-utilized.

Parallel to the metal core 1, there is disposed a bed 9 in which a shaping member or knife 10 is fixed. Member 10 is provided with cut-outs 11 which determine the profile of a baluster configuration during a first phase.

Bed 9 can be oscillated, thus facilitating with withdrawal and arrangement of the piece.

An operating lever 12 may operate the electromotor and reduction gear assembly 6, which causes the member 4 to rotate, and therefore, causes the core 1 together with its coating to rotate about the member 5.

It has been verified in practice that a speed greater than two revolutions per second prevents the adherence of the coating, and thus lower speeds will be used.

The mass of concrete to be deposited will be separately prepared with a suitable granulometry and proportioning, and then will be placed close to the machine so that the operator can take it and deposit it on the knife 10, while pressing the mass against the core 2 with a tool (for example bricklayers' trowel) and distributing it.

Figure 4:
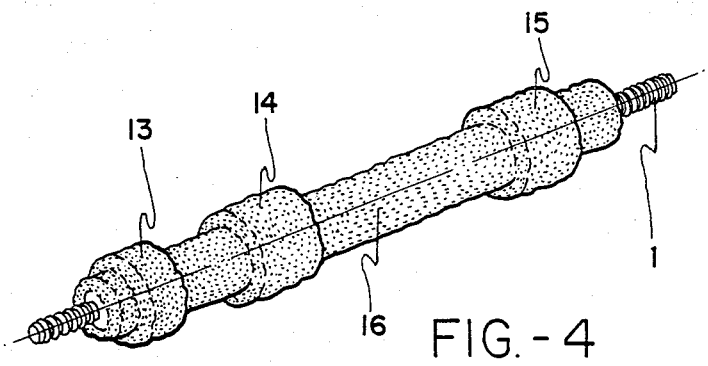
FIG. 4 is a perspective view of an intermediate phase in the production of a baluster.
Figure 5:
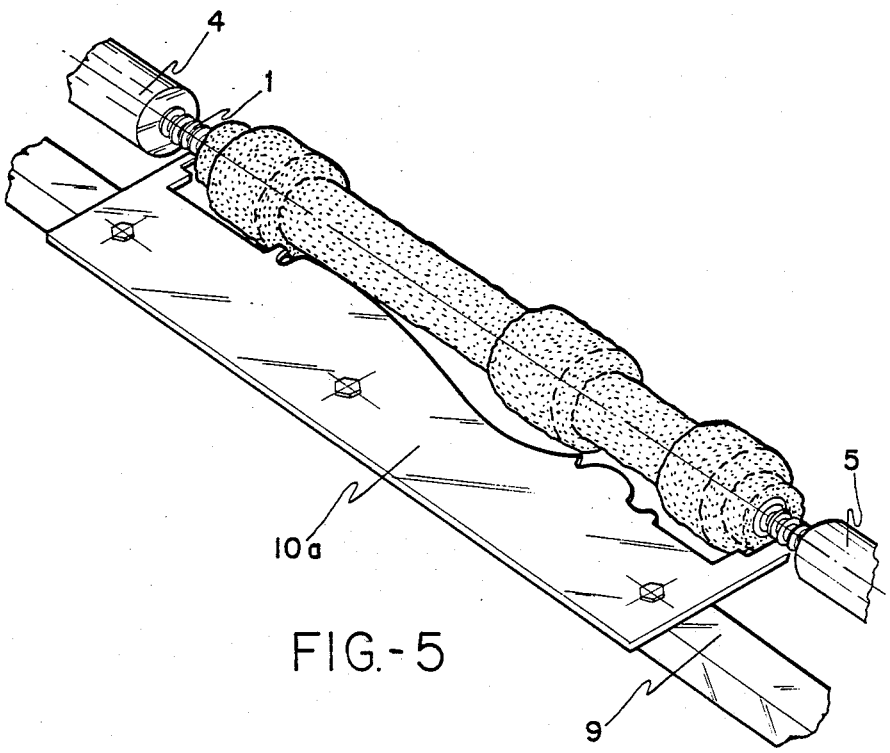
FIG. 5 is a perspective view of such baluster located between pivoting points and positioned adjacent another shaped knife having a configuration closer to that of the baluster to be formed.

Some of the concrete mass will fall through the openings defined by the cut-outs 11 into the tray 8, while other portions of the mass will adhere to and thicken the core 2. As the concrete mass thus is added to the core, the knife 10 strikes the mass tangentially, removing excess mass and shaping the remaining mass according to the shape of knife 10, thus to reproduce the generatrix constituted thereby, and refining the surface until the contemplated shape is reached, as indicated in FIG. 4 of the drawings.

Such shaped piece has thickened portions 14 and 15 which protrude from a base coating portion 16. These thickened portions will coincide with parts of the baluster to have a greater volume.

Once the time for presetting such piece has lapsed, the assembly is positioned between the members 4 and 5, and the cycle is repeated using a knife 10*a* which has a shape closer to the final shape to be given to the finished baluster and using a finger aggregate granulometry with a richer proportioning.

Figure 6:
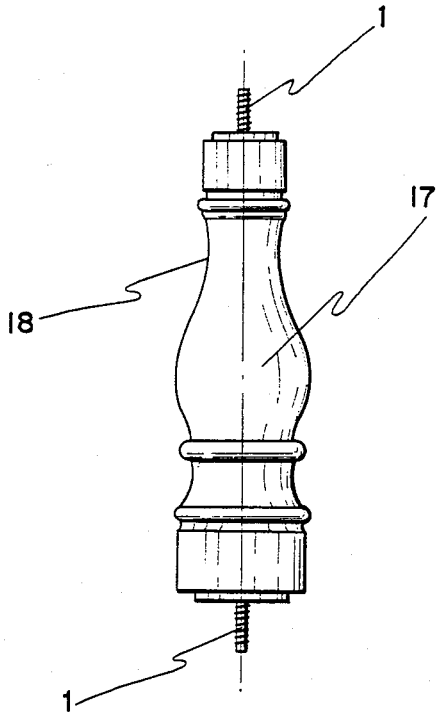
FIG. 6 is an elevation view of a finished baluster after the application or not of prefinal phases.

After this coating operation, the piece obtained is again subjected to presetting, then being ready for a following operation in which a final finish is given to the piece, as illustrated in FIG. 6.

The number of intermediate phases depends on the volume of the thickened portions 17 of the final piece with respect to the smaller diameter portions 18 thereof. In any case, the presetting time of the intermediate phases is variable, depending on the time, temperature and moisture conditions which, in turn depend on the size, thickness and materials of which the piece is composed.

The baluster can have any kind of finish, using from pulverized glass to aggregates coloured with pigmented binders.

The industrial process here described can be carried out either continuously or by phases, permitting mixed series to be carried out by merely changing the shape of the knives which are cheap and easy to construct.

It should be pointed out that the machines or working benches used are light and readily transportable, whereby the position and distribution thereof can be reorganized, depending on the production schedule required in each particular case.

I claim:

1. A process for forming a baluster from aggregates and a binder, said process comprising:

providing a rigid longitudinal core;

forming on said core a cylindrical body of a mass of aggregate and binder thereby forming an assembly;

rotating the assembly of said core and body about the longitudinal axis of said core;

providing a first shaping member having an edge irregularly shaped to be complementary to a desired longitudinal profile to be imparted to said assembly;

positioning said first shaping member with said edge adjacent a surface of rotation of said body of said assembly;

applying a first mass of aggregate and binder to said surface of rotation such that said applied first mass rotates with said assembly and is shaped by said edge as said assembly rotates therepast, thereby forming a shaped assembly;

removing said first shaping member; positioning a second shaping member, having an edge irregularly shaped with a configuration different from that of said edge of said first shaping member and to be complementary to a further longitudinal profile to be imparted to said shaped assembly, with said edge of said second shaping member adjacent the surface of rotation of said shaped assembly; and applying a second mass of aggregate and binder to said surface of rotation of said shaped assembly, said second mass having a finer granulometry than said first mass, such that said applied second mass rotates with said shaped assembly and is shaped by said edge of said second shaping member as said shaped assembly rotates therepast, thereby forming a further shaped assembly in the configuration of a baluster.

2. A process as claimed in claim 1, comprising rotating said assembly at a speed not greater than two revolutions per second.

3. A process as claimed in claim 1, comprising positioning said shaping members such that said edges extend generally radially of said assembly.

4. A process as claimed in claim 1, comprising positioning said shaping members such that said edges extend generally tangentially of said assembly.

5. A process as claimed in claim 1, comprising adding further masses of aggregate and binder having successively finer granulometry, by means of further shaping members having irregularly shaped edges, thereby further shaping said assembly.

* * * * *